US008205983B2

(12) United States Patent
Sakano et al.

(10) Patent No.: US 8,205,983 B2
(45) Date of Patent: Jun. 26, 2012

(54) IMAGE RECORDING APPARATUS

(75) Inventors: Yuji Sakano, Toyota (JP); Masahiro Nishizaki, Iwakura (JP); Koji Nakayama, Seki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1115 days.

(21) Appl. No.: 12/056,029

(22) Filed: Mar. 26, 2008

(65) Prior Publication Data

US 2008/0239049 A1 Oct. 2, 2008

(30) Foreign Application Priority Data

Mar. 28, 2007 (JP) ..... 2007-083580

(51) Int. Cl.
*B41J 2/01* (2006.01)

(52) U.S. Cl. ..... 347/104

(58) Field of Classification Search ..... None
See application file for complete search history.

(56) References Cited

U.S. PATENT DOCUMENTS

| | | | | |
|---|---|---|---|---|
| 5,674,345 | A * | 10/1997 | Nash | 156/264 |
| 2004/0160475 | A1 | 8/2004 | Satoh et al. | |
| 2004/0246324 | A1 | 12/2004 | Nakashima | |
| 2005/0194730 | A1 * | 9/2005 | Nishida et al. | 271/10.01 |
| 2005/0206708 | A1 | 9/2005 | Yoda | |
| 2008/0043083 | A1 * | 2/2008 | Imoto et al. | 347/104 |

FOREIGN PATENT DOCUMENTS

| | | | |
|---|---|---|---|
| JP | H01-169550 | U | 11/1989 |
| JP | 2001233529 | A | 8/2001 |
| JP | 2005-145586 | A | 6/2005 |
| JP | 2005-239405 | A | 9/2005 |
| JP | 2006256790 | A | 9/2006 |

OTHER PUBLICATIONS

Japan Patent Office; Notice of Reasons for Rejection in Japanese Patent Application No. 2007-083580 (counterpart to the above-captioned U.S. Patent Application) mailed Feb. 3, 2009. (partial translation).

European Patent Office; Search Report in European Patent Application No. 08005982.7 (counterpart to the above-captioned U.S. patent application) mailed Mar. 19, 2010.

Patent Office of the People's Republic of China; The First Office Action in Chinese Patent Application No. 2008100870273 (counterpart to the above-captioned U.S. patent application) mailed Aug. 28, 2009.

* cited by examiner

*Primary Examiner* — Matthew Luu
*Assistant Examiner* — Kendrick Liu
(74) *Attorney, Agent, or Firm* — Baker Botts L.L.P.

(57) ABSTRACT

An image recording apparatus includes a recording head that records an image on a record medium, a first and a second rollers respectively having rotation shafts parallel to each other, and an endless conveyor belt which is looped around the first and second rollers, and which has an external surface for conveying thereon a record medium in a conveyance direction from the first roller toward the second roller while supporting the record medium. On the circumferential surface of the second roller, provided are a abutting region abutting the internal surface of the conveyor belt, and a larger diameter region not abutting the internal surface of the conveyor belt and having a radius surpassing a sum of a thickness of the conveyor belt and a radius of the abutting region.

8 Claims, 4 Drawing Sheets

IMAGE RECORDING APPARATUS

The present application claims priority from Japanese Patent Application No. 2007-83580, which was filed on Mar. 28, 2007, the disclosure of which is herein incorporated by reference in its entirety.

BACKGROUND OF THE INVENTION

1. Field of the Invention

The present invention relates to an image recording apparatus having a configuration that a record medium having an image recorded thereon in an image recording section is conveyed by a conveyor belt and then separated from the conveyor belt in a separating section.

2. Description of Related Art

Japanese Unexamined Patent Application Publication No. 2006-256790 discloses an inkjet recording apparatus including an endless conveyor belt that adsorbs a record medium on the external surface thereof by electrostatic action, and a recording head that records an image by ejecting ink droplets on the record medium adsorbed to the external surface of the conveyor belt. In this inkjet recording apparatus, a plurality of conveyor belts are looped around a drive roller and a driven roller in a direction perpendicular to the conveyance direction of a record medium with a predetermined space therebetween. This inkjet recording apparatus includes a separation guide having a body plate and a plurality of teeth extended from the body plate toward the upstream in the conveyance direction. The body plate is disposed further downstream from the drive roller positioned downstream form the recording head. Each of the teeth extended from the body plate is positioned between two of the conveyor belts adjacent to each other. The plurality of teeth of the separation guide contact the lower face of a record medium conveyed by the plurality of conveyor belts, thereby separating the record medium from the conveyor belts, to forward the record medium to the body plate. That is, peeled from the plurality of conveyor belts by the plurality of teeth of the separation guide, the record medium is separated from the plurality of conveyor belts, irrespective of the radius of curvature of the conveyor belts. Therefore, separation of a record medium from the plurality of conveyor belts can be ensured without a need of consuming power, while allowing the plurality of conveyor belts to last longer.

However, in the inkjet recording apparatus of the above publication, the body plate of the separation guide is positioned downstream from the conveyor belts, and a feed roller and a spur roller are paired and are positioned further downstream from the body plate. This results in a long length of the inkjet recording apparatus in the conveyance direction of a record medium, which is against recent demands for downsizing an inkjet recording apparatus.

SUMMARY OF THE INVENTION

It is an object of the present invention to provide a small image recording apparatus whose length in a conveyance direction is shortened as much as possible and which is being capable of surely peeling a record medium from the external surface of a conveyor belt.

According to an aspect of the present invention, provided is an image recording apparatus including: a recording head that records an image on a record medium; a first and second rollers whose respective rotation shafts are parallel to each other; and an endless conveyor belts each of which is looped around the first and second rollers, and has an external surface for conveying thereon a record medium in a conveyance direction from the first roller toward the second roller while supporting the record medium. The second roller has, on a circumferential surface thereof, an abutting region abutting an internal surface of the conveyor belt, and a larger diameter region which does not abut the internal surface of the conveyor belt and has a radius surpassing a sum of a thickness of the conveyor belt and a radius of the abutting region.

Since the present invention does not adopt a member which is positioned downstream from the conveyor belt as is the case of the separation guide in Japanese Unexamined Patent Application Publication No. 2006-256790, it is possible to shorten the length of the image recording apparatus in the conveyance direction. In addition, providing the larger diameter region on the circumferential surface of the second roller ensures that a record medium is peeled from the conveyor belt. This increases the adsorptivity to hold a record medium on the conveyor belt, thereby preventing separation of record medium from the conveyor belt. Furthermore, the larger diameter region prevents the conveyor belt from shifting in the axial direction of the second roller.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
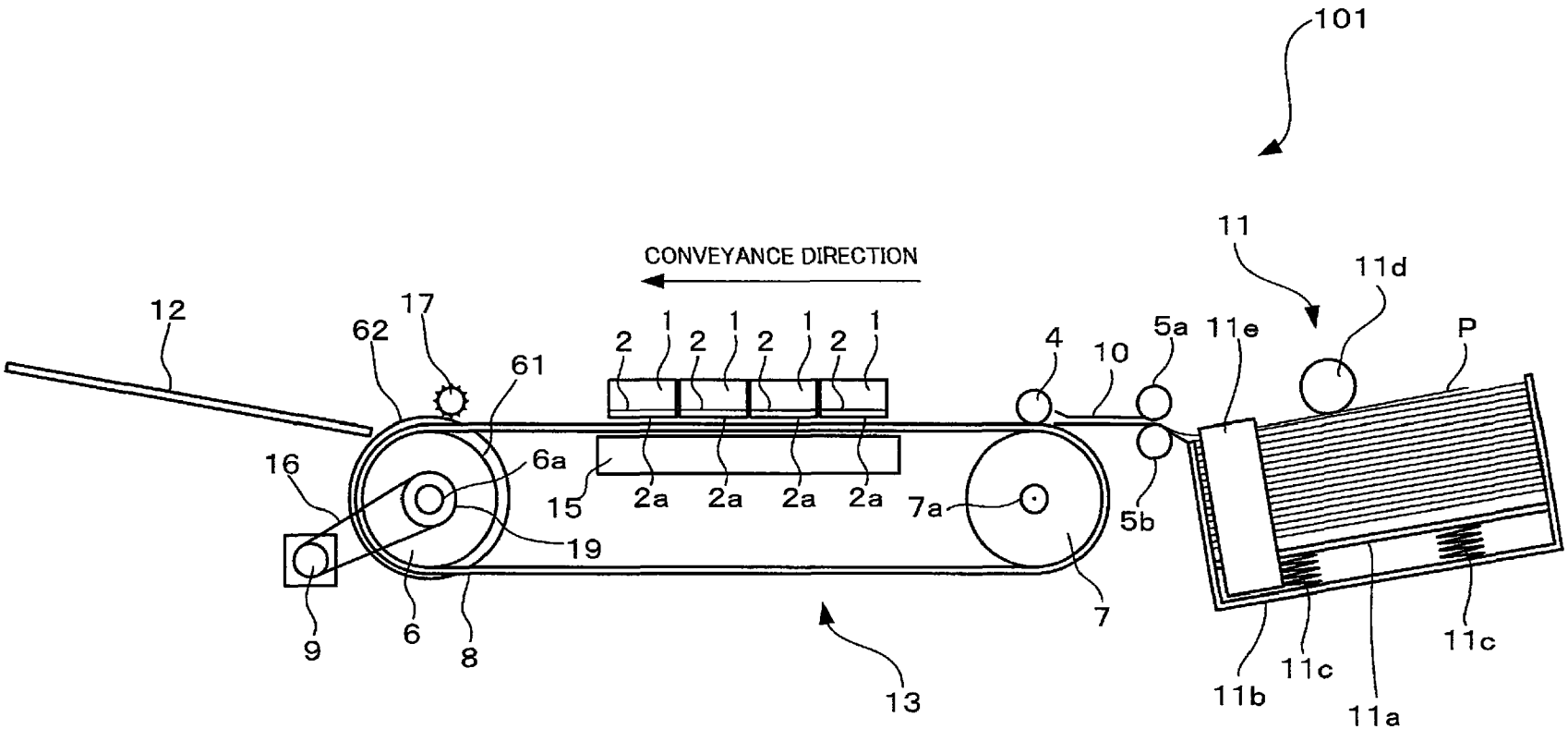
FIG. 1 is a schematic side view providing an overview of a configuration of an inkjet printer that is an image recording apparatus according to an embodiment of the present invention.
Figure 2:
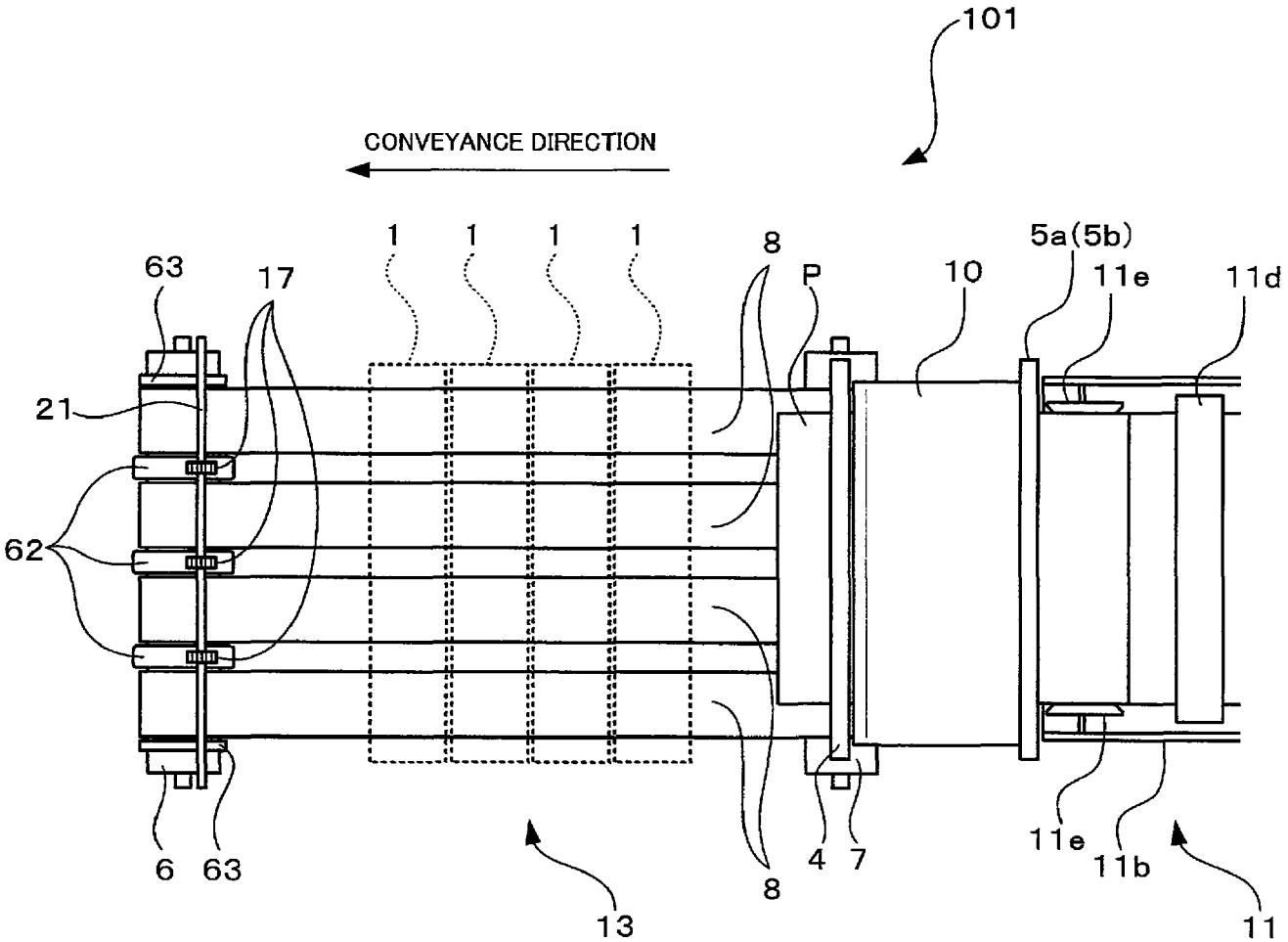
FIG. 2 is a plan view of the inkjet printer shown in FIG. 1.

As shown in FIGS. 1 and 2, an inkjet printer 101 which is an image recording apparatus according to an embodiment of the present invention has: a sheet feed unit 11 which feeds a predetermined-size sheet P, i.e., a record medium; a belt conveying mechanism 13 which conveys the sheet P fed from the sheet feed unit 11 while supporting the sheet P on the external surface of four conveyor belts 8; four inkjet heads 1 which eject ink droplets on the sheet P conveyed by the belt conveying mechanism 13 so as to record an image on the sheet P; and a discharge tray 12 which receives the sheet P with the image recorded thereon. The discharge tray 12 is not an essential component, and therefore, the discharge tray 12 may be omitted for the purpose of downsizing the entire inkjet printer 101. In this embodiment, the predetermined-size sheet P has a rectangular shape which complies with a standard (A4 size, B5 size, postcard size, or the like).

The inkjet printer 101 includes therein a sheet conveyor path where the sheet P is conveyed in a conveyance direction from the sheet feed unit 11 toward the discharge tray 12 (a direction from the right toward the left in FIGS. 1 and 2). An operation of each section of the inkjet printer 101 is controlled by a not-shown controller.

The four inkjet heads 1 serving as recording heads respectively eject ink droplets of four different colors including Yellow, Cyan, Magenta, and Black. Thus, the inkjet printer 101 is a color inkjet printer. The inkjet printer 101 is a linetype printer in which the heads 1 are fixed so that the longitudinal direction of the four inkjet heads 1 is perpendicular to the conveyance direction. At lower parts of the four inkjet heads 1, head main bodies 2 are fixed, respectively. The head main bodies 2 have an elongated rectangular parallelepiped shape with its length in a direction perpendicular to the conveyance direction. The under surfaces of the head main bodies 2 are ejection faces 2*a* having a plurality of ejection openings for ejecting ink droplets.

The sheet feed unit 11 includes a sheet tray 11*a*, a sheet stocker 11*b*, a plurality of coil springs 11*c*, a pick-up roller 11*d*, and a pair of positioning plates 11*e*. On the sheet tray 11*a*, a stack of sheets P is placed. The sheet tray 11*a* is disposed within the sheet stocker 11*b*, and the sheet stocker 11*b* having an opening at the top thereof is capable of stocking the plurality of sheets P stacked on the sheet tray 11*a*. The plurality of coil springs 11*c* holds the sheet tray 11*a* upward. With the elastic force of the coil springs 11*c*, the pick-up roller 11*d* always abuts the sheet P laid at the top of the plurality of sheets P stocked in the sheet stocker 11*b*. Each of the positioning plates 11*e* has almost the same height as that of the sheet stocker 11*b*, and is positioned in the vicinity of a downstream end of the sheet stocker 11*b*, slightly apart from a side wall of the sheet stocker 11*b* in a direction towards inside the sheet stocker 11*b*. The inner surfaces of the positioning plates 11*e* abut the ends, of the sheets P, which are extended in the conveyance direction. As described later, the positioning plates 11*e* are positioned so that the both ends of the sheet P are positioned on different conveyor belts 8, respectively.

In accordance with an instruction from the not-shown controller, the pick-up roller 11*d* cooperates with a not-shown separation mechanism to send out at a predetermined timing a sheet P at the top of the stack to the left, i.e. to the inkjet heads 1. At the left of the sheet feed unit 11, a pair of feed rollers 5*a*, 5*b* are disposed. The pair of feed rollers 5*a*, 5*b* send out the sheet P from the sheet feed unit 11 to the further left. The sheet P sent to the left by the pair of feed rollers 5*a*, 5*b* passes between a pair of guide plates 10. The guide plates 10 are disposed apart from each other in an up/down direction so as to face each other and let pass the sheet P therebetween. The sheet P having passed through the guide plates 10 then reaches the belt conveying mechanism 13. Note that it is possible to provide a pair of separation rollers 5*a*, 5*b* in the separation mechanism, in which case the separation roller 5*a* rotates in a direction of conveying a sheet P to the inkjet heads 1, while the separation roller 5*b* serves as a retard roller rotating in a direction of conveying the sheet P to the sheet feed unit 11.

The belt conveying mechanism 13 includes: two belt rollers 6, 7 respectively having rotation shafts 6*a*, 7*a* parallel to each other; four endless conveyor belts 8 looped around the both rollers 6, 7; a platen 15; and a motor 9.

The belt roller 6 as a second roller is positioned downstream from the belt roller 7 serving as a first roller, interposing the four inkjet heads 1 therebetween. Each of the conveyor belts 8 includes an adhesive layer capable of having the sheet P adhered thereto, and therefore the external surface of the conveyor belt 8 is adhesive. The four conveyor belts 8 are arranged parallel to each other so that adjacent belts are apart from each other by an equal distance, in the axial direction of the belt rollers 6, 7 (a direction perpendicular to the conveyance direction).

Above the belt roller 7, a nip roller 4 is disposed. The nip roller 4 presses down the sheet P, which has been sent by the feed rollers 5*a*, 5*b* and interposed between the nip roller 4 and the belt roller 7, on to the adhesive external surface of the four conveyor belts 8.

The motor 9 drives a rotation shaft 6*a* of the belt roller 6 via an endless transmission belt 16 looped around an output shaft of the motor and a transmission roller 19 concentric with the belt roller 6. As a result, the belt roller 6 serving as a drive roller rotates counterclockwise around the rotation shaft 6*a*. This rotation of the belt roller 6 rotates the belt roller 7 serving as a driven roller in the counterclockwise direction around a rotation shaft 7*a*. With the counterclockwise rotation of the belt rollers 6 and 7, the sheet P pressed down by the nip roller 4 onto the external surfaced of the four conveyor belts 8 is conveyed in a direction from the belt roller 7 to the belt roller 6 on the left, while being supported on supporting surfaces which are upper planes of the external surfaces of the conveyor belts 8, extended parallel to the ejection faces 2*a*. In this embodiment, the belt roller 6 which is located downstream from the belt rollers 7 is used as a drive roller. This creates stable tension on the supporting surfaces of the conveyor belts 8, thereby restraining formation of creases on the supporting surfaces. In the illustration of FIG. 1, the motor 9 is positioned further downstream from the downstream end of the belt roller 6 in the conveyance direction. However, this illustration is for clearly showing the endless transmission belt 16 is looped around the output shaft of the motor 9 and the transmission roller 19, and is not intended to show that the motor 9 needs to be positioned further downstream from the downstream end of the belt roller 6 in the conveyance direction. To downsize the entire inkjet printer 101, it is preferable that the motor 9 be positioned upstream from the downstream end of the belt roller 6 in the conveyance direction.

The platen 15 is disposed within a region surrounded by the internal surfaces of the four conveyor belts 8, and has an upper plane opposed to the ejection faces 2*a* of the inkjet heads 1. The upper plane of the platen 15 supports the four conveyor belts 8 so as to prevent the conveyor belts 8 from warping downward in the region where the supporting surfaces of the four conveyor belts 8 face the ejection faces 2*a*.

When a sheet P conveyed by the four conveyor belts 8 passes below the four head main bodies 2 sequentially, ink droplets of different colors are selectively ejected from the ink ejection faces 2*a* toward an upper face of the sheet P, i.e. a record face of the sheet P, according to image data to be recorded. As a result, an intended image is formed on the record face of the sheet P.

Figure 3:
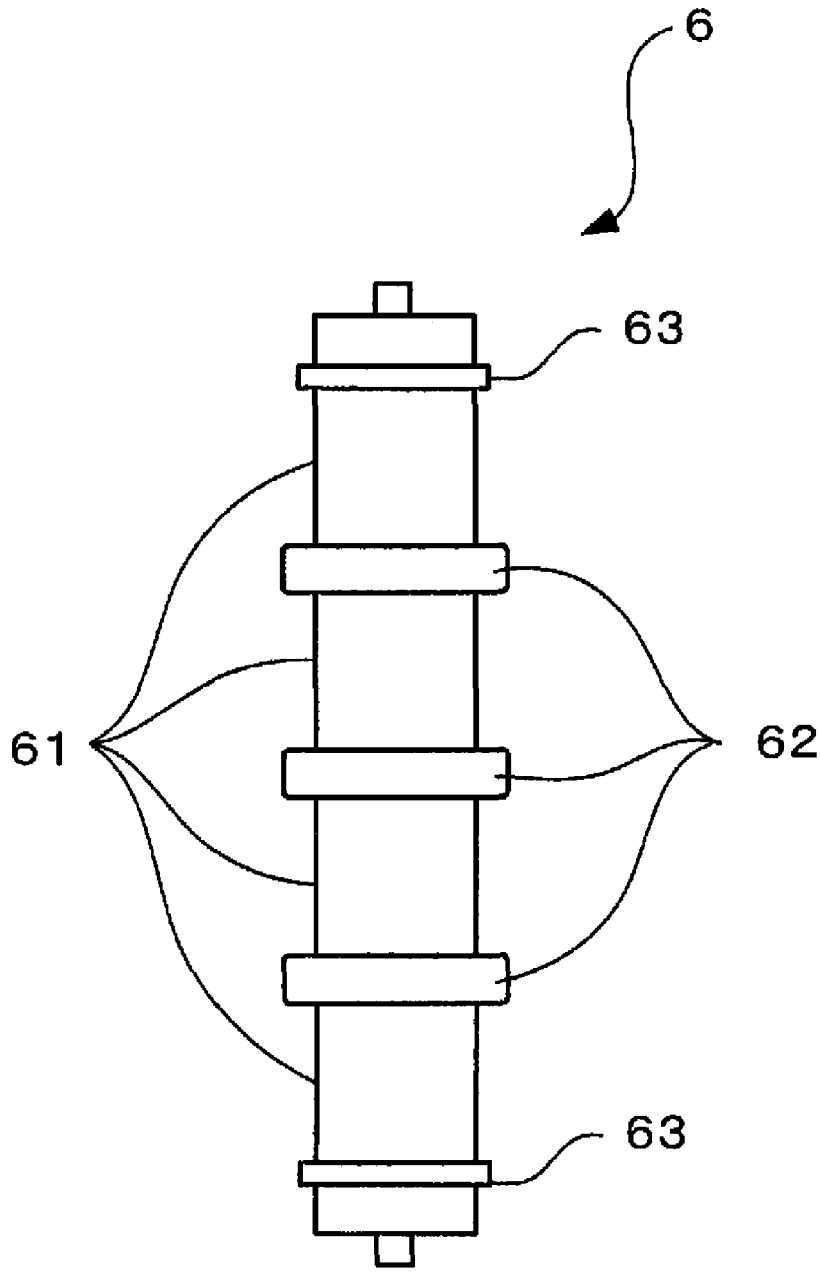
FIG. 3 is a plan view of a belt roller which is one of the components of the inkjet printer shown in FIG. 1.

FIG. 3 is a plan view of the belt roller 6.

On the circumferential surfaces of the belt roller 6, annular protrusions 63 each serving as a belt stopper are formed so that each of the annular protrusions 63 is apart from the endmost one of the larger diameter regions 62 by the width of each transfer belt 8. A protruding amount of the protrusions 63 from the abutting regions 61 is smaller than that of the larger diameter regions 62.

Returning to FIG. 1 and FIG. 2, the four conveyor belts 8 are looped over the belt roller 6 so that the internal surfaces thereof abut the four abutting regions 61 of the belt rollers 6, respectively. As described above, since the width of each of the abutting regions 61 and that of each of the conveyor belts 8 are the same, the four conveyor belts 8 are spaced apart from each other, by the width of each of the larger diameter regions 62, in the axial direction of the belt roller 6. In other words, each of two inner belts out of the four conveyor belts 8 is sandwiched with no space between two of the larger diameter regions 62. On the other hand, each of two outer belts out of the four conveyor belts 8 is sandwiched with no space by one of the larger diameter regions 62 and one of the protrusions 63. Therefore, the four conveyor belts 8 are not shifted in the axial direction thereof.

In this embodiment, the sheets P are positioned by the positioning plates 11*e* so that the both ends of a sheet P having the largest size among all the predetermined-sizes supported by the inkjet printer 101, which ends are extended in the conveyance direction, are positioned on two endmost conveyor belts 8 closest to the both ends of the belt roller 6. Furthermore, this embodiment adopts four conveyor belts 8. However, it is preferable to determine the number of the conveyor belts 8 and to position the sheet P with the positioning plate 11*e* so that, even when a smaller predetermined-size sheet than the largest one is conveyed, the both ends of the smaller sheet P in the conveyance direction are respectively positioned on two conveyor belts 8. This is because the both ends of the sheet P in the conveyance direction are hardly lifted from the supporting surfaces, and therefore stable image recording is possible, when the both ends are respectively positioned on two conveyor belts 8. Note that a predetermined-size sheet P in this embodiment has a rectangular shape which complies with a standard (A4 size, B5 size, postcard size, or the like), as is already mentioned.

When a sheet P conveyed on the supporting surfaces of the four conveyor belts 8 reaches the larger diameter regions 62, the sheet P runs onto the diameter regions 62 successively from the leading end of the sheet P to the trailing end, with the rotation of the belt rollers 6, 7. This gradually peels the sheet P from the external surface of the conveyor belts 8. As described above, the belt roller 6 of this embodiment is provided with the larger diameter regions 62 which ensure that the sheet P is peeled from the external surface of the conveyor belts 8 at the downstream end of the supporting surfaces. This allows increase in the adhesion of the external surface of the conveyor belts 8, thereby preventing separation of the sheet P from the conveyor belts 8. In addition, this embodiment does not employ a member positioned downstream from the conveyor belts 8, as is the case of the separation guide in Japanese Unexamined Patent Application Publication No. 2006-256790. It is therefore possible to shorten the length of the inkjet printer 101 in the conveyance direction; i.e., the length in a direction of an arrow indicated in FIG. 1 as the conveyance direction. Therefore, downsizing of the entire inkjet printer 101 is possible. Furthermore, the larger diameter regions 62 prevent the four conveyor belts 8 from shifting in the axial direction of the belt roller 6.

On the belt roller 6, the abutting regions 61 and the larger diameter regions 62 are alternately arranged along the axial direction thereof, and therefore a conveyance force and a peel force are evenly applied to the left and right of a sheet P. This prevents tilting of the sheet P, while it is conveyed on the supporting surfaces.

Furthermore, each of the larger diameter regions 62 is sandwiched by two of the abutting regions 61. This eliminates an unnecessary work of forming another larger diameter region 62 which never contacts a sheet P on further outward position of the abutting regions 61 contacting the conveyor belts 8 where the both ends of the sheet P are positioned. Thus, it is possible to down size the inkjet printer 101 also in the lateral direction thereof; i.e., a direction perpendicular to a sheet face in FIG. 1.

A shaft 21 above the belt roller 6, which extends parallel to the rotation shaft 6*a* of the roller, is provided with three spur rollers 17 fitted loosely and freely rotatable. Each of the spur rollers 17 has a plurality of radially extending protrusions arranged at an equal interval in the circumferential direction of the spur rollers 17. The spur rollers 17 are disposed opposite to the larger diameter regions 62 so that a sheet P is pinched between the spur rollers 17 and the larger diameter regions 62. The spur rollers 17 are urged by an urging member (e.g. a helical spring or leaf spring) so as to press down the larger diameter regions 62 while abutting the larger diameter regions 62. The movement of each of the spur rollers 17 in the axial direction is restricted by a not-shown positioning member so that the spur rollers 17 surely oppose to the larger diameter regions 62.

As described above, the spur rollers 17 are urged by the urging member onto the larger diameter regions 62 of the belt roller 6, and a sheet P conveyed on the supporting surfaces of the conveyor belts 8 is pinched between the spur rollers 17 and the belt roller 6. Therefore, a further conveyance force is applied to a sheet P, while it is being separated and delivered from the belt conveying mechanism 13. Thus, the speed of the sheet P is not sharply reduced at the time of delivering the sheet P from the belt conveying mechanism 13. Accordingly in this embodiment, the discharge tray 12 tilted as shown in FIG. 1 to ascend from the belt roller 6 is able to receive the sheet P delivered from the belt conveying mechanism 13. Thus, with the use of the spur rollers 17, it is no longer required that the discharge tray 12 be tilted to descend from the supporting surfaces of the conveyor belts 8. This improves the flexibility of positioning the discharge tray 12. Furthermore, the spur rollers 17 also provide an advantageous effect that, the sheet P in a position upper stream from the spur rollers 17 is kept from being lifted from the conveyor belts 8, until the trailing end of the sheet P passes between the spur rollers 17 and the belt roller 6.

Since the sheet P is interposed between each of the spur rollers 17 and each of the larger diameter regions 62 of the belt roller 6, the conveyor belts 8 are not damaged by the spur rollers 17.

Figure 4A:
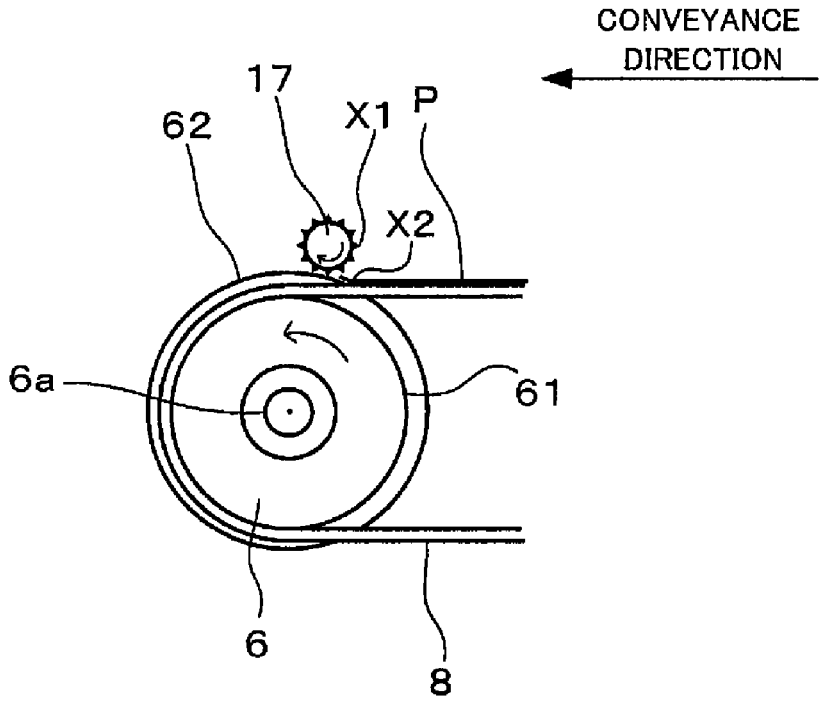
FIGS. 4A and 4B are enlarged side views of the vicinity of the belt roller of the inkjet printer shown in FIG. 1.
Figure 4B:
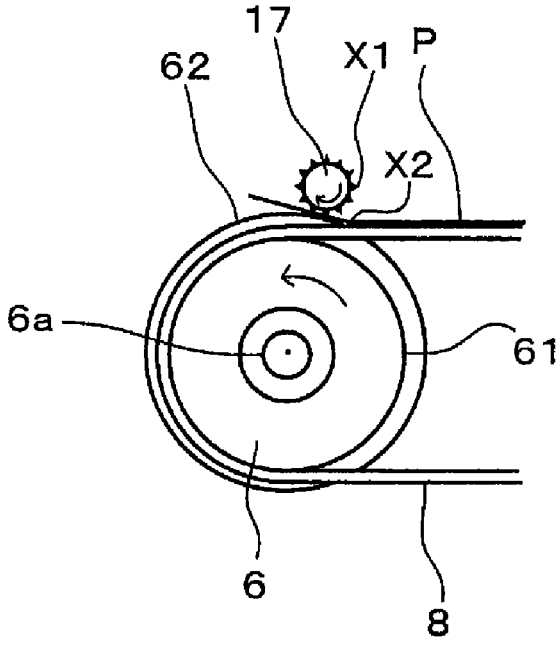

Now further referring to FIG. 4A and FIG. 4B, the position of the spur rollers 17 will be described in more detail. FIG. 4A is an enlarged side view of the vicinity of the belt roller 6 of the inkjet printer 101, at a time immediately before the sheet P is pinched between the spur rollers 17 and the belt roller 6. FIG. 4B is an enlarged side view of the vicinity of the belt roller 6 of the inkjet printer 101, at a time immediately after the sheet P is pinched between the spur rollers 17 and the belt roller 6.

As shown in FIG. 4A, each of the spur rollers 17 is located slightly upstream, from the point immediately above the rotation shaft 6*a* of the belt roller 6, in the conveyance direction. Furthermore, each of the spur rollers 17 is positioned at a level higher than the external surface of the associated one of the conveyor belts 8. If the spur roller 17 is moved to upstream in the conveyance direction along the larger diameter region 62 from the point immediately above the rotation shaft 6*a* of the belt roller 6, so that a portion of the protrusions of the spur roller 17 is positioned at a level lower than the external surface of the associated one of the conveyor belts 8, the leading edge of the sheet P conveyed on the supporting surface of the conveyor belt 8 abuts a protrusion of the spur roller 17 before the leading edge abuts the larger diameter region 62. This may cause a jam of the sheet P. On the other hand, such a situation does not occur in this embodiment.

It is supposed that X1 is the most upstream end of the spur roller 17 in the conveyance direction, i.e., a right end of the super roller 17 in FIGS. 4A and 4B. It is further supposed that X2 is a point where the supporting surface of the conveyor belt 8 crosses the larger diameter region, i.e., a point along the conveyance direction where the height of the supporting surface coincide with that of the larger diameter region. The X1 in this embodiment is positioned upstream from the X2 in the conveyance direction. If X1 is positioned downstream from X2 in the conveyance direction and if the leading edge of the sheet P abutting the larger diameter region 62 at X2 advances in a direction away from the larger diameter region 62, the leading edge may abut a portion of the spur rollers 17 above X1. This is another situation where the above mentioned jam of the sheet P may take place. However, since X1 in this embodiment is positioned upstream from X2 in the conveyance direction, the leading edge does not abut the portion of the spur rollers 17 above X1 even if the leading edge of the sheet P advances in the direction away from the larger diameter region 62. In other words, it becomes easier for the leading edge of the sheet P to advance towards a nip point where the spur roller 17 contacts the larger diameter region 62, as shown in FIG. 4B. Therefore, a jam of the sheet P is surely prevented.

Further, the spur rollers 17 are positioned upstream from the most downstream end of the belt roller 6 in the conveyance direction. As such, no member exists downstream from the most downstream end. Therefore, the entire inkjet printer 101 is downsized. Even in the case that a discharge tray is provided further downstream from the most downstream end of the belt roller 6, it is possible to flexibly design the position of the discharge tray. This improves the design flexibility.

The above embodiment deals with a case of adopting the conveyor belts 8 having adhesive external surface; however, air suction or electrification may be used for adsorbing a sheet P to the external surface of the conveyor belts. Furthermore, the above embodiment deals with a case where the respective numbers of conveyor belts, abutting regions, and larger diameter regions provided are two or more; however, the numbers of those members may be one.

Both ends of a record medium may be positioned on a single conveyor belt, or positioned over a gap between two adjacent conveyor belts. The abutting regions and the larger diameter regions are not necessarily alternated in the axial direction of the belt roller 6. Further, it may be a larger diameter region which is provided at each outermost end of the belt roller 6 in the axial direction.

The above embodiment deals with a case where the belt roller 6 is provided with the protrusions 63 serving as a belt stopper. The belt roller 6 does not necessarily have to include the protrusions 63. Further, the drive roller may be the belt roller 7.

The spur rollers 17 may be arranged immediately above the rotation shaft 6*a* of the belt roller 6. In that case, it is preferable that the spur rollers 17 be controlled so as to be displaced up or down along with the conveyance of a sheet P. Further, a sheet P may be pinched between the spur rollers 17 and the external surface of the conveyor belts 8. Further, the spur rollers 17 do not necessarily have to be provided.

In the belt roller 6, a abutting region and a larger diameter region are not necessarily formed integrally. For example, a larger diameter region may be formed with the external surface of a ring press-fitted into a column-shaped belt roller 6.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus, comprising:

a recording head that records an image on a record medium;

a spur roller having a plurality of radially extending protrusions arranged, at even intervals, in a circumferential direction of the spur roller;

a first and second rollers whose respective rotation shafts are parallel to each other; and an endless conveyor belt looped around the first and second rollers, and has an external surface for conveying thereon a record medium in a conveyance direction from the first roller toward the second roller while supporting the record medium, wherein the record medium conveyed by the conveyor belt is given a conveyance force when interposed between the spur roller and the second roller, wherein the second roller has, on a circumferential surface thereof, an abutting region abutting an internal surface of the conveyor belt, and a larger diameter region which does not abut the internal surface of the conveyor belt and has a radius surpassing a sum of a thickness of the conveyor belt and a radius of the abutting region; and wherein the spur roller is positioned, so that a most upstream portion of the spur roller in the conveyance direction is positioned upstream from a point in the conveyance direction where the external surface of the conveyor belt and the larger diameter region intersect, when viewed from the side in a direction perpendicular to the conveyance direction; so that the most upstream portion of the spur roller is downstream of the most upstream portion of the second roller; and so that the spur roller is positioned at a level higher than the external surface of the conveyor belt.

2. The image recording apparatus according to claim 1, wherein the spur roller is positioned upstream from a most downstream end of the second roller in the conveyance direction.

3. The image recording apparatus according to claim 1, wherein the recording medium is interposed between the spur roller and the larger diameter region of the second roller.

4. The image recording apparatus according to claim 1, further comprising another conveyor belt which is spaced apart from the conveyor belt in the axial direction of the second roller, wherein the two conveyor belts are positioned so that, when a predetermined-size record medium on which an image is to be recorded by the recording head is conveyed, both sides of the recording medium along the conveyance direction are positioned respectively on the conveyor belt and the other conveyor belt.

5. The image recording apparatus according to claim 1, further comprising another conveyor belt which is spaced apart from the conveyor belt in the axial direction of the second roller, wherein the second roller has a plurality of the abutting regions so that the number of the abutting regions corresponds to that of the conveyor belts, and one or more larger diameter regions, and the plurality of the abutting regions and the one or more larger diameter regions are alternately arranged on the second roller in the axial direction thereof.

6. The image recording apparatus according to claim 5, wherein all of the larger diameter regions and the plurality of the abutting regions are aligned in the axial direction so that each of the larger diameter regions is positioned between two of the plurality of the abutting regions.

7. The image recording apparatus according to claim 6, wherein the second roller has a protrusion serving as a stopper for the conveyor belt, formed on a portion of the second roller in the axial direction, the portion being closer to an end of the second roller than an outermost one of abutting regions is to the same.

8. The image recording apparatus according to claim 1, wherein the second roller is a drive roller.

* * * * *